United States Patent [19]

Witcher

[11] 4,054,235

[45] Oct. 18, 1977

[54] CONTINUOUS FORMS SHEET SEPARATOR

[75] Inventor: Leonard Dean Witcher, San Jose, Calif.

[73] Assignee: International Business Machines Corporation, Armonk, N.Y.

[21] Appl. No.: 676,015

[22] Filed: Apr. 12, 1976

[51] Int. Cl.[2] ..... B65H 27/00

[52] U.S. Cl. ..... 226/200; 270/52.5; 270/61 F; 226/195; 226/196

[58] Field of Search ..... 226/44, 39, 113, 114, 226/195, 196, 200; 270/52.5, 61 F; 197/133, 133 P

[56] References Cited

U.S. PATENT DOCUMENTS

| | | | |
|---|---|---|---|
| 2,779,450 | 1/1957 | Mecum | 197/133 |
| 2,906,527 | 9/1959 | Blain | 270/61 F |
| 3,446,554 | 5/1969 | Hitchcock | 226/113 X |
| 3,578,229 | 5/1971 | Macomber | 226/114 |
| 3,851,839 | 12/1974 | Hynes | 226/195 X |
| 3,857,557 | 12/1974 | Gill | 270/52.5 |

*Primary Examiner*—Richard A. Schacher
*Attorney, Agent, or Firm*—Otto Schmid, Jr.

[57] ABSTRACT

Apparatus to separate multiple sheet feeds from fan-fold paper being moved from an input paper stack upwardly to a print station. The separator apparatus includes a separator member, and flexible members support the separator member for swinging movement in the paper path in a position to bear against the paper as it moves from the input paper stack. The separator member has a mass so that it may selectively move or be moved by the paper and the resultant frictional engagement and impact on the paper web causes multiple sheet feeds to be separated from the web near the input paper stack.

1 Claim, 4 Drawing Figures

CONTINUOUS FORMS SHEET SEPARATOR

BACKGROUND OF THE INVENTION

The present invention relates to a paper feeding system and more particularly to improved systems for use in a high speed printer employing fan-fold continuous forms paper.

As the speed of a printer increases, the problem of feeding continuous form sheets of fanfold paper to the printer becomes progressively more severe. The high process speeds do not permit time for any operator intervention to alter the condition of the continuous forms paper as it is received, and to further reduce the operator handling of the paper, the paper may be fed into the printer from the boxes in which the paper is received. The elimination of operator preprocessing of the forms may produce a problem since the paper is closely packed in the box so that most of the air is compressed out of the sheet stack. There is a tendency for the sheets to cling together as the sheets are removed from the box. The conditions which may result in the sheets clinging together include static charge, edge cutting, loose paper fibers generated during the perforation operation and turned up edges. If not corrected before entry into the paper feed mechanism, the multiple sheet feed may produce jams, tears or other malfunctions along the paper line.

Attempts have been made to solve the problem of multiple sheets feeds by various means which produce a frictional drag on the sheets such as bars or brushes mounted across the path of the sheets. The bars or brushes can lead to sheet tears along the path due to sheets becoming caught or to damage of the forms in the area of the tractor holes due to too great a frictional drag caused by the bars or brushes.

It is therefore the principal object of this invention to provide apparatus to eliminate the problem of multiple sheet feeds in the input to a high speed printer.

It is another object of this invention to provide apparatus operable to eliminate the problem of multiple sheet feeds that is operable with all standard paper sizes without requiring adjustment for paper size.

SUMMARY OF THE INVENTION

Briefly, according to the invention, there is provided an elongated separator member mounted by elongated flexible support means for swinging movement relative to the vertical run of fan-fold paper above the input paper stack wherein the separator member impacts and is impacted by the fan-fold paper web so that multiple sheet feeds are separated from the web being fed to a printing station.

DESCRIPTION OF THE PREFERRED EMBODIMENT

Figure 1:
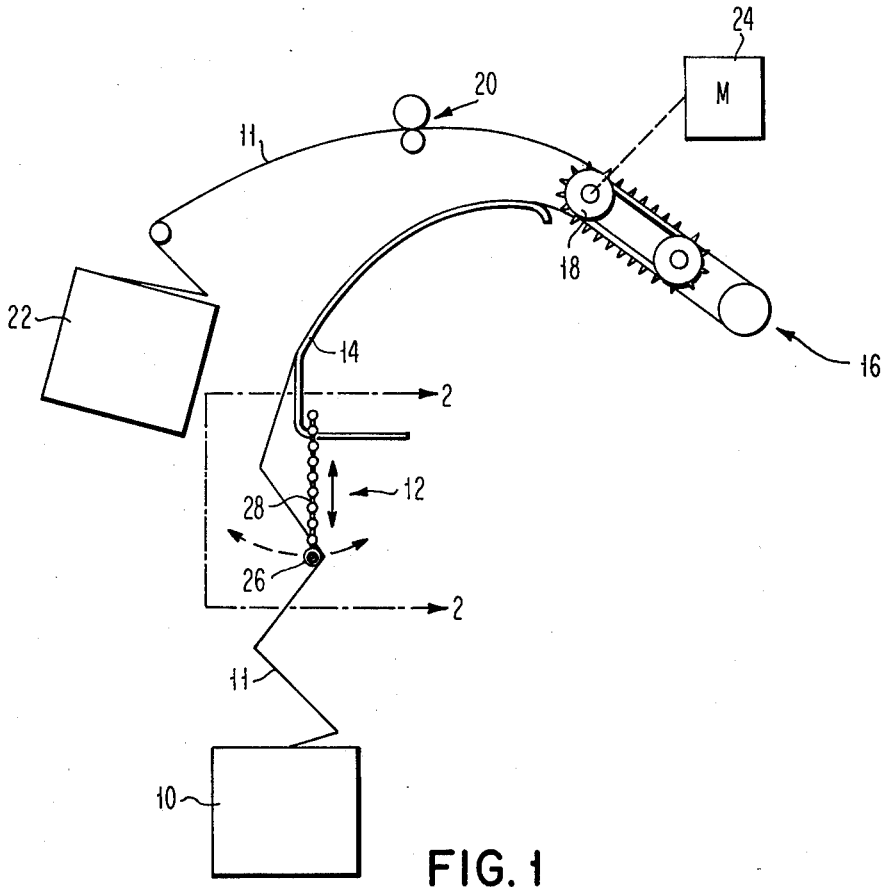
FIG. 1 is a side view of a printer paper line embodying the present invention.

In accordance with the present invention, a printer fan-fold sheet feed path is shown in the drawings.

The sheet feed path extends from the input paper stack 10 through a sheet separator apparatus 12 and continues along sheet guide means 14 to the print station 16. Sheet feeding means 18 is provided to drive the paper along the sheet feed path to and through the print station. Auxiliary feeding means 20 may be provided to feed the sheets to sheet refolding means 22.

The sheets are provided in a web of continuous forms in which sheets are connected by a transverse line of perforations and these sheets are customarily stacked in fan-fold configuration. The paper at initial thread-up is manually guided along the sheet path and through the bottom part of sheet feeding means 18. The sheet web is passed through the print station and then passed through the upper part of sheet feeding means 18 and along the remainder of the sheet feed path. Motor 24 provides the drive to sheet driving means 18. Once the paper web is threaded through the printer, further operation is under control of the printer control unit which provides suitable electrical drive to motor 24.

The fan-fold paper web 11 from the input stack extends in a generally vertical run through the sheet separator means 12 and up to guide means 14. Guide means 14 also functions as the support for sheet separator means 12. Suitable flexible elongated support members support the separator member for swinging movement in the paper path in a position to bear against the paper web as it moves from the input stack towards the guide means. The separator member has a mass so that it may selectively move or be moved by the paper without damage to the perforation. The resulting frictional engagement and impact on the web causes multiple sheet feeds to be separated from the web while it is being fed between the input paper stack and guide means 14.

Figure 2:
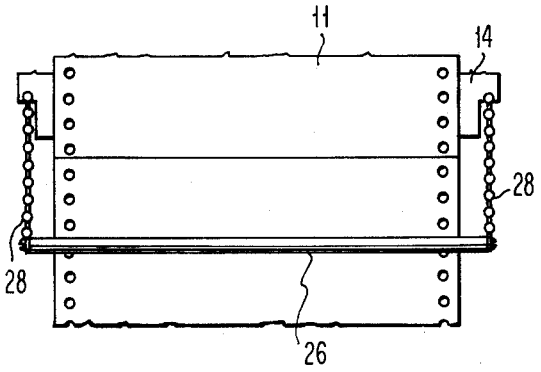
FIG. 2 is a partial section view along the lines 2—2 in FIG. 1.

The input paper stack is located in an offset position relative to paper guide means 14. The sheets in the input paper stack may be in the shipping box or out of the box with the stack integrity maintained. The sheet separator apparatus 12 comprises an elongated separator member 26 which extends completely across the sheet path. Separator member 26 may have any desired cross section so long as it does not catch on the sheets or damage the perforations between sheets. A standard steel bar has been found to give satisfactory results. As shown in FIG. 2, the bar member 26 extends completely across the widest sheet with room to spare so that a slight misalignment of the paper will not permit the edges to catch on support means 28. This configuration also permits a side-to-side motion of separator member 26 without support member 28 catching on the edge of the paper web. The separator member is supported near its ends with suitable elongated flexible support means 28 which is fixed at the other end to sheet guide means 14. Support means 28 comprises any material which has essentially the same flexibility in every direction normal to its direction of elongation so that the separator member is free to swing back and forth, move from side to side and up and down to prevent the separator member from catching on the paper and tearing it. Separator member 26 is supported ideally in line with the middle of the input paper stack and approximately equidistant between the top of the input paper stack 10 and guide means 14. However, since the printer is to process all standard lengths of sheets, the separator member is centered over the middle of the average length of sheet to be fed.

As the paper is driven through the printer, the web is pulled against separator bar member 26 which causes the bar member to be deflected to the left as shown by the arrow. For small angles the motion of bar member 26 approaches that of a simple pendulum. The weight of the bar member supplies a restoring force which causes the bar member to impact the web. During normal operation, the separator member can be observed to produce a motion of swinging back and forth as the web is fed through the paper line. The impact, in addition to the frictional engagement of the bar on the web, causes multiple sheets to separate and fall back into the feed area allowing one sheet through. The length of support means 28 is chosen to provide the proper natural frequency of the pendulum motion relative to the paper feed speed and the sheet sizes to be processed.

A system according to the invention was designed with mass and suspension suitable for over 100 combinations of sheet length ranging from 6 to 12 inches and sheet widths ranging from 6½ to 14⅞ inches. The system had a process speed of over 30 inches per second and the length of support means 28 was chosen at about 8 inches. In this embodiment the support means comprised a bead chain. This length produced a natural frequency of the motion faster than the fastest sheet oscillation. In this embodiment the separator member 26 comprised a ¼ inch diameter rod 18 9/16 inches long. Prior to the addition of this separator means, the system had an unacceptable rate of occurrence of multiple sheet feeds. The addition of this separator means changed the rate of occurrence of multiple sheet feeds to an infrequent rate of occurrence.

Any multiple sheet feeds must be separated in the paper path between the top of the input paper stack and guide means 14. Once a multiple sheet feed reaches guide means 14, the chances are slight that the sheets can be separated before reaching sheet feeding means 18 where they may cause either a torn web or a jam. Either of these conditions would result in lost printing time due to the necessity for operator intervention to correct the problem.

Figure 3A:
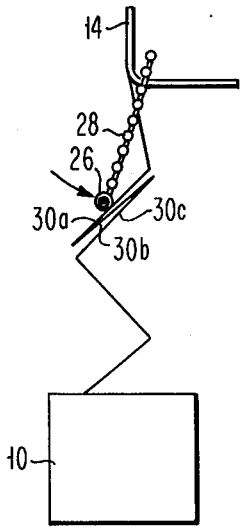
FIGS. 3A and 3B are side views of a part of the printer paper line showing how the multiple fed sheets separate.
Figure 3B:
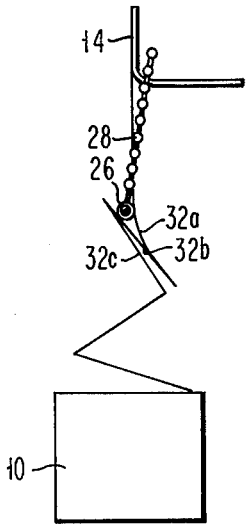

As shown in FIG. 3*a,* a multiple sheet feed is shown in which a sheet 30*a* is in the normal feed path and sheets 30*b* and 30*c* are clinging to this sheet. Separator member 26 is shown in position to impact the sheet 30*a* and knock away sheets 30*b* and 30*c.* It sometimes happens that the multiple sheet feed is due to sheets caught intermediate the ends as shown in FIG. 3*b.* This type of feed may be caused by a chad hole or an edge crimped over. In this case, separator member 26 may enter the opening between sheets 32*a* and 32*b* and in this manner separate sheets 32*b* and 32*c* from sheet 32*a.*

While the invention has been particularly shown and described with reference to a preferred embodiment thereof, it will be understood by those skilled in the art that various changes in the form and details may be made therein without departing from the spirit and scope of the invention.

What is claimed is:

1. In a paper driving system of the type wherein paper is fed along a path from an input stack of fan-folded paper initially in an upward direction to a printing station, the combination comprising:

a guiding and supporting member spaced upwardly from said input stack along said path, an elongated separator member, a pair of flexible elongated support members each comprising bead chains fixed at one end to opposed lateral sides of said guiding and support member and fixed at the other end to opposed ends of said elongated separator member to support said separator member adjacent said fan-folded paper above said input stack, said separator member having a mass sufficiently small that the separator member may be moved by the web and sufficiently large that the separator member may follow its natural tendency to swing so that the resultant reaction causes multiple sheet feeds of said web from said input stack to be separated from the web being fed upwardly toward said printing station.

* * * * *